US009269339B1

(12) United States Patent
Taube

(10) Patent No.: US 9,269,339 B1
(45) Date of Patent: Feb. 23, 2016

(54) AUTOMATIC TONAL ANALYSIS OF MUSICAL SCORES

(71) Applicant: Illiac Software, Inc., Champaign, IL (US)

(72) Inventor: Heinrich Taube, Champaign, IL (US)

(73) Assignee: Illiac Software, Inc., Champaign, IL (US)

( * ) Notice: Subject to any disclaimer, the term of this patent is extended or adjusted under 35 U.S.C. 154(b) by 0 days.

(21) Appl. No.: 14/728,852

(22) Filed: Jun. 2, 2015

Related U.S. Application Data

(60) Provisional application No. 62/006,733, filed on Jun. 2, 2014.

(51) Int. Cl.
*G10H 1/00* (2006.01)

(52) U.S. Cl.
CPC ..... *G10H 1/00* (2013.01); *G10H 1/0025* (2013.01); *G10H 2210/081* (2013.01); *G10H 2210/555* (2013.01)

(58) Field of Classification Search
USPC ..... 84/616
IPC ..... G10H 1/00,2210/081, 2210/555
See application file for complete search history.

(56) References Cited

U.S. PATENT DOCUMENTS 4,960,031 A * 10/1990 Farrand ..... G09B 15/023 84/462
5,396,828 A * 3/1995 Farrand ..... G09B 15/023 84/462
5,563,358 A * 10/1996 Zimmerman ..... G09B 15/00 84/454
5,786,583 A * 7/1998 Maltsev ..... G06K 7/14 235/462.15
6,166,314 A * 12/2000 Weinstock ..... G10G 3/04 84/477 R
9,165,543 B1 * 10/2015 Vorobyev ..... G10H 1/40
2006/0126452 A1 * 6/2006 Yamashita ..... G11B 27/105 369/30.23
2006/0156904 A1 * 7/2006 Gabert ..... G09B 15/00 84/483.2
2007/0193435 A1 * 8/2007 Hardesty ..... G10H 1/0025 84/609
2007/0240559 A1 * 10/2007 Hasebe ..... G10H 1/386 84/637
2008/0087160 A1 * 4/2008 Gabert ..... G09B 15/00 84/478
2008/0196576 A1 * 8/2008 Samuel ..... G10H 1/383 84/613
2008/0221895 A1 * 9/2008 Pauws ..... G11B 27/038 704/270
2008/0271592 A1 * 11/2008 Beckford ..... G10H 1/0008 84/645
2008/0307945 A1 * 12/2008 Gatzsche ..... G09B 15/023 84/477 R
2008/0314228 A1 * 12/2008 Dreyfuss ..... G09B 15/00 84/477 R
2009/0173216 A1 * 7/2009 Gatzsche ..... G10H 1/0008 84/613

(Continued)

*Primary Examiner* — David Warren
(74) *Attorney, Agent, or Firm* — Singleton Law Firm, P.C.

(57) ABSTRACT

Embodiments of the present invention provide a tonal analysis method including the steps of parsing notes of a musical score to generate a time-ordered plurality of sonorities; confirming a plurality of tonal centers each having a tone; accounting a chord of a sonority for a confirmed tonal center to determine whether the chord of the sonority is a functional symbol of the confirmed tonal center; and identifying a tonally stable region of the musical score for a confirmed tonal center, then accounting the chord of each sonority in a tonally stable region as a functional symbol of that tonal center. Embodiments of the present invention provide a non-transitory computer-readable medium which stores the output of the tonal analysis method as sonority data structures associated with theory line entry data structures.

15 Claims, 19 Drawing Sheets

(56) References Cited

U.S. PATENT DOCUMENTS

2010/0175539 A1* 7/2010 Silbert ..... G10H 1/0066 84/612
2010/0313737 A1* 12/2010 Fahn ..... G06K 9/00 84/477 R
2010/0313739 A1* 12/2010 Lupini ..... G10H 1/0008 84/611
2011/0004476 A1* 1/2011 Saino ..... G10H 1/0008 704/267
2011/0036231 A1* 2/2011 Nakadai ..... G10H 1/361 84/477 R
2011/0277617 A1* 11/2011 Yamauchi ..... G10H 1/10 84/615
2013/0000465 A1* 1/2013 Gurule ..... G10H 1/0025 84/609
2013/0042746 A1* 2/2013 Shau ..... G09B 15/023 84/483.1
2013/0077447 A1* 3/2013 Hiratsuka ..... G10H 15/023 367/199
2014/0000438 A1* 1/2014 Feis ..... G10G 1/00 84/453
2015/0277731 A1* 10/2015 Uemura ..... G10G 1/00 715/765
2015/0279342 A1* 10/2015 Uemura ..... G10G 1/00 84/483.2
2015/0302758 A1* 10/2015 Tunogai ..... G10G 1/02 84/470 R

* cited by examiner

C:I I $I^{6}$ $ii^{6}_{5}$ V I $I^{6}$ V V vii$^{o6}$ $I^{6}$ $ii^{6}_{5}$ V I

G: I C: V

FIG. 12B 6 6/5 6 7-6/♯6 6 6/5 ♯

FIG. 12C

CM CM $CM^{6}$ $Dm^{6}_{5}$ GM CM $CM^{6}$ GM GM F♯$^{o6}$ $GM^{6}$ $Am^{6}_{5}$ DM GM

FIG. 12D

M M $M^{6}$ $m^{6}_{5}$ M M $M^{6}$ M M $^{o6}$ $M^{6}$ $m^{6}_{5}$ M M

FIG. 12E

AUTOMATIC TONAL ANALYSIS OF MUSICAL SCORES

CROSS-REFERENCE TO RELATED APPLICATIONS

The present application claims the benefit of U.S. Provisional Patent Application No. 62/006,733, filed Jun. 2, 2014, which is hereby incorporated by reference in its entirety.

BACKGROUND OF THE INVENTION

The present invention generally relates to music theory. More particularly, the present invention relates to a system and method for algorithmic tonal analysis and musical notation search.

Tonal analysis is an element of the field of music theory and musical analysis. While a written musical score represents the musical notes that make up a musical work, music theory provides an explanatory framework for musical organization, patterns, and structure that have not been explicitly written into the score. Analysis of a musical score relies on principles of music theory to identify characteristics of the written musical notes that convey concepts such as chords, harmonies, and tones.

In musical performance, notes may be performed by instruments or voices, and each set of notes played by a particular instrument or voice constitutes a part. A chord refers to a set of musical notes sounded together, and harmony refers to the use of chords and their constituent notes in conjunction to produce a desired musical effect. Notes and chords may have particular roles or functions in producing a desired harmonic progression, and knowledge of these functions informs how a note or chord should be played by a musician. A note which is not a part of a chord may be referred to as a non-harmonic tone, though it may still play a role in the overall harmony of a musical work.

The human skill of musical analysis is learned over a course of years of music education to understand the underlying principles of music theory, as well as extensive practice to be able to apply this knowledge to a musical score on a first impression. Whereas the form of the elements of a musical score, such as the identity of each individual chord, may be determined by routine examination of the notes and intervals written in a musical score, the function of those same elements is not readily apparent. A variety of functional theories may be possible to explain the function of each chord of a musical score, but not all such theories can be correct. The manual analysis of functional theories may, consequently, be time-consuming and fallible in practice.

Moreover, the education of musical analysis skills requires students to be tested in the application of imparted knowledge and principles. By known methods of teaching musical analysis, students must manually write down compositions and the results of functional analysis of compositions, and present these solutions to instructors for manual review. The instructor must review both the compositions presented to the student and any compositions and analysis results written by the student, analyze both, and compare results to determine errors. No systematic procedure for such comparison has been developed.

BRIEF SUMMARY OF THE INVENTION

Embodiments of the present invention provide a tonal analysis method. Steps of the tonal analysis method according to an embodiment of the present invention may include parsing notes of a musical score to generate a time-ordered plurality of sonorities; confirming a plurality of tonal centers each having a tone; accounting a chord of a sonority for a confirmed tonal center to determine whether the chord of the sonority is a functional symbol of the confirmed tonal center; and identifying a tonally stable region of the musical score for a confirmed tonal center, then accounting the chord of each sonority in a tonally stable region as a functional symbol of that tonal center.

Embodiments of the present invention provide a non-transitory computer-readable medium which stores a note data record representing a note of the musical score stored as an element of a voice data structure; a voice data structure stored as an element of a parts data structure; a sonority data structure representing a sonority, containing references to each of a subset of note data records of the plurality of note data records, and associated with a theory line entry data structure wherein the accounting of each sonority as a functional symbol of a confirmed tonal center is stored.

Steps of the tonal analysis method according to an embodiment of the present invention may further include parsing notes of a musical score by identifying a starting beat time for each note; generating a timeline of all starting beat times; at each starting beat time, sampling each note sounding at the starting beat time for the smallest note value and generating a sonority comprising the sampled notes; determining a relative metric stress level for each sonority; and reducing the notes of each sonority to pitch class set notes.

Steps of the tonal analysis method according to an embodiment of the present invention may further include converting pitch class set notes of a sonority to an interval set; matching the interval set against a chord dictionary comprising intervals associated with chord identities in order to classify the interval set as the associated chord identity; and recording the associated chord identity in the theory line entry data structure associated with the sonority data structure representing the sonority.

Steps of the tonal analysis method according to an embodiment of the present invention may further include identifying a non-sonority note of the notes of the musical score; testing the non-sonority note against a target sonority to determine whether the non-sonority note is a non-harmonic tone; and if the non-sonority note is a non-harmonic note, recording the identification of the non-sonority note as a non-harmonic note in the theory line entry data structure associated with the sonority data structure representing the sonority.

Steps of the tonal analysis method according to an embodiment of the present invention may further include generating a melodic interval set for each non-harmonic tone; matching the interval set against a non-harmonic tone model dictionary comprising melodic intervals associated with non-harmonic tone identities in order to classify the melodic interval set as the associated non-harmonic tone identity; and recording the associated non-harmonic tone identity in the theory line entry data structure associated with the sonority data structure representing the sonority.

Steps of the tonal analysis method according to an embodiment of the present invention may further include testing a pair of sonorities among the plurality of sonorities for tonal center confirmation by evaluating a condition determining whether the test pair implies a tonal center tone, and a condition determining whether an implied tonal center tone is touched.

Steps of the tonal analysis method according to an embodiment of the present invention may further include accounting a chord of a sonority is against a confirmed tonal center by determining the interval between the root tone of the sonority and the tone of the confirmed tonal center; matching the interval and the tone of the confirmed tonal center against a tonal center dictionary comprising scale degrees each associated with a tonal center tone and one or more chord models; and if the interval matches against a matching scale degree and the tone of the confirmed tonal center matches against the tonal center tone associated with the matching scale degree, then matching the chord of the sonority against the chord models associated with the matching scale degree; if the chord of the sonority matches against a chord model associated with the matching scale degree, then accounting the chord of the sonority as a functional symbol of the confirmed tonal center; and recording the accounting of the chord of the sonority as a functional symbol of the confirmed tonal center in the theory line entry data structure associated with the sonority data structure representing the sonority.

Steps of the tonal analysis method according to an embodiment of the present invention may further include accounting a chord of a sonority is accounted against a confirmed tonal center by claiming a region of the musical score between a pair of adjacent confirmations of a confirmed tonal center as a tonally stable region; accounting each chord of a sonority within a tonally stable region as a functional symbol of the confirmed tonal center; and recording the accounting of the chord of the sonority as a functional symbol of the confirmed tonal center in the theory line entry data structure associated with the sonority data structure representing the sonority.

Steps of the tonal analysis method according to an embodiment of the present invention may further include evaluating an error condition against a sonority; and if the error condition is true against the sonority, recording an error annotation in the theory line entry data structure associated with the sonority data structure representing the sonority.

Steps of the tonal analysis method according to an embodiment of the present invention may further include generating an annotated representation of a musical score comprising musical score elements of the musical score, a theory line element, and markup token elements, wherein a theory line element has a display mode corresponding to a chord notation.

BRIEF DESCRIPTION OF THE DRAWINGS

FIGS. 12B through 12E illustrate possible theory line elements for the annotated representation of FIG. 12A with display modes using a Roman numeral notation, a figured bass notation, a chord symbol notation, and a chord type notation, respectively.

DETAILED DESCRIPTION OF THE INVENTION

Figure 1A:
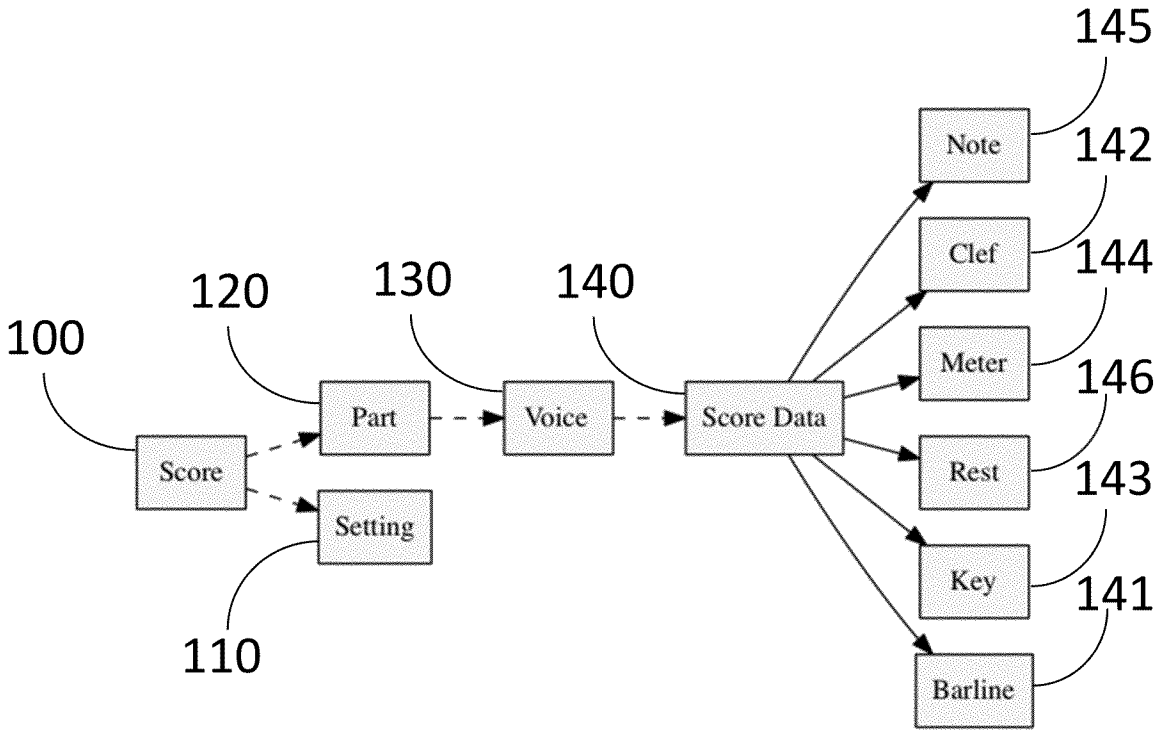
FIG. 1A illustrates a musical score data structure according to an embodiment of the present invention.

FIG. 1A illustrates a musical score data structure 100 according to an embodiment of the present invention. The musical score data structure 100 may be recorded on a non-transitory computer-readable medium. The musical score data structure 100 is a representation of musical score elements of a musical score. The musical score data structure 100 contains a settings data structure 110 and a parts data structure 120.

Musical score elements may include staffs, clefs, key signatures, bar divisions, meters, tempos, and notes.

A settings data structure 110 may contain a setting record 111, where a setting record 111 is a data record containing a name and a value associated with the name. A parts data structure 120 may contain a part record 121, where a part record 121 is a data record containing a plurality of names and values associated with a part of a musical score represented by the musical score data structure 100. Throughout this specification, the term "part" with respect to the invention shall have its customary meaning in music theory referring to elements of a musical score for performance by a single instrument or voice, or by a group of identical instruments or voices.

A part record 121 may contain a name, an instrument assignment, a melodic line identifier, a staff identifier, and a voice data structure 130. A voice data structure 130 is a data structure containing a plurality of score data records 140 associated with a melodic line of a musical score, where a melodic line is a collection of notes of the musical score. A score data record 140 may be a data structure representing a characteristic of a melodic line. A score data record 140 may be a barline data record 141, a clef data record 142, a key data record 143, a meter data record 144, a note data record 145, or a tempo data record 146.

A barline data record 141 may be a data record containing a value representing bar divisions of a musical score. A clef data record 142 may be a data record containing a value representing a clef of a musical score. A key data record 143 may be a data record containing a value representing a key signature of a musical score. A meter data record 144 may be a data record containing a value representing a meter of a musical score. A note data record 145 may be a data record containing a value representing a note of a musical score. A tempo data record 146 may be a data record containing a value representing a tempo of a musical score.

A note data record 145 may further contain a time value representing the time in the musical score at which the note represented by the note data record 145 is written. Time in the musical score may be a dimension incrementing relative to the left-to-right position of a note on a staff of the musical score. A further left note antedates a further right note. A further right note succeeds a further left note. More than one note may occur in the same left-to-right position, represented by more than one corresponding data records having the same time value.

Figure 2:
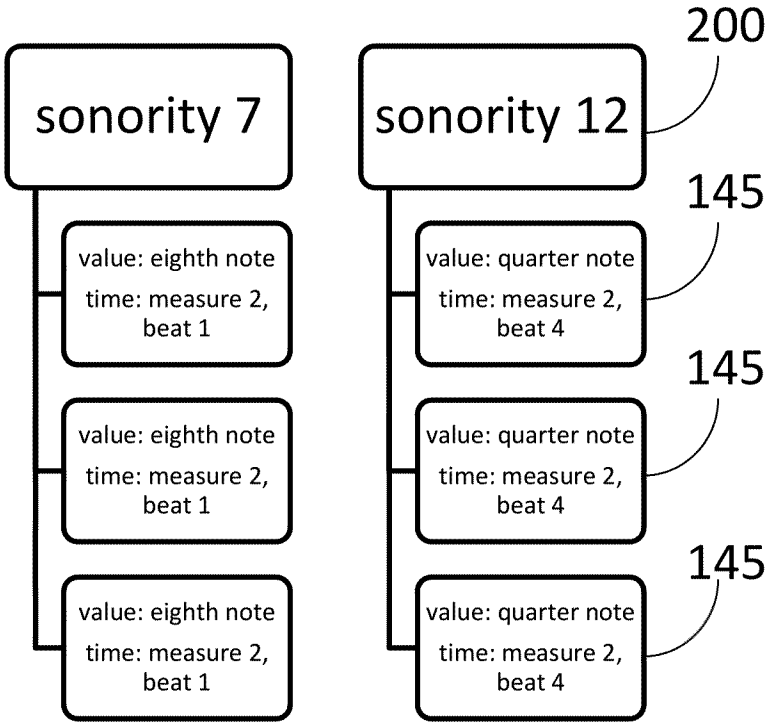
FIG. 2 illustrates a sonority data structure according to an embodiment of the present invention.

FIG. 2 illustrates a sonority data structure 200 according to an embodiment of the present invention. A sonority data structure 200 may represent a subset of notes of a musical score. The subset of notes may be the set of all sounding notes that are present at an articulation of a note in the musical score. A sonority data structure 200 may contain note data records 145 of a musical score data structure 100, or may contain references thereto.

Figure 3:
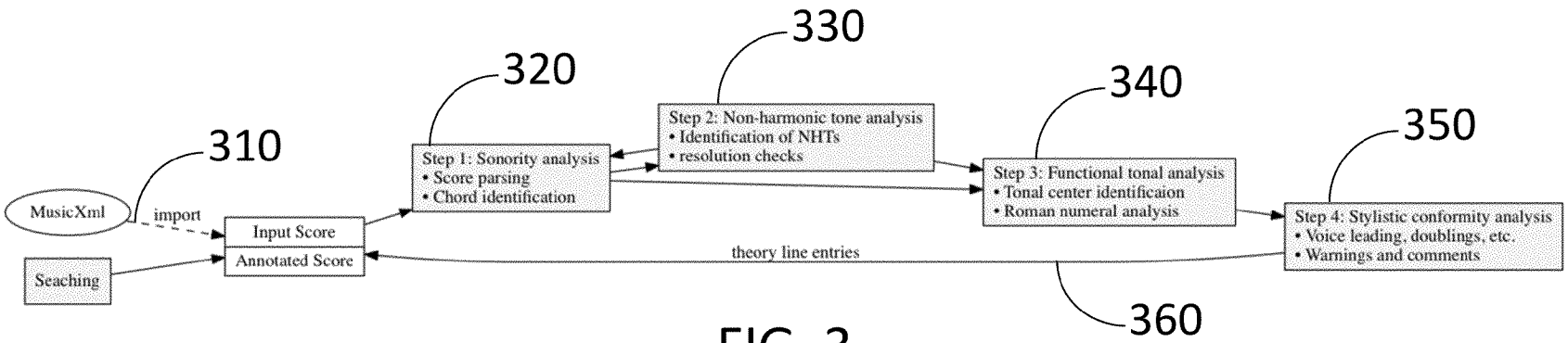
FIG. 3 illustrates a flow chart of a tonal analysis method according to an embodiment of the present invention.

FIG. 3 illustrates a flow chart of a tonal analysis method 300 according to an embodiment of the present invention. In a first step 310 of the tonal analysis method 300, a musical score is converted to a musical score data structure 100 and stored. In a next step 320 of the tonal analysis method 300, the musical score data structure 100 is parsed to identify sonorities of the musical score. In a next step 330 of the tonal analysis method 300, non-harmonic tones of the musical score are classified. In a next step 340 of the tonal analysis method 300, tonal centers of the musical score are identified from the sonorities of the musical score, and functional theories of the musical score are constructed from the tonal centers of the musical score. In a next step 350 of the tonal analysis method 300, errors and stylistic anomalies are identified, and annotations are generated. In a next step 360 of the tonal analysis method 300, an annotated graphical representation of the musical score is generated. The steps of the tonal analysis method 300 may be executed by computer code stored on a non-transitory computer-readable medium.

According to embodiments of the present invention, during a step 310 of the tonal analysis method 300, a musical score may be initially recorded in the form of a written or printed musical score. A musical score may, alternately, be initially recorded in the form of an electronic musical score document recorded on a non-transitory computer-readable medium. For example, an electronic musical score document may be a MusicXML document formatted according to specifications distributed by MakeMusic, Inc. A musical score, whether in a written, printed, or electronic form, may include musical score elements. A musical score element in a written or printed musical score may be visually represented using a musical notation system as known to persons of ordinary skill in the art. A musical score element in an electronic musical score document may be semantically representing using markup elements as defined in an electronic musical score notation specification.

Conversion of a musical score to a musical score data structure 100 may be performed by a human user. A human user may visually read a written or printed musical score to determine the musical score elements of the written or printed musical score. A human user may interact with a computer having a display, input device, processor, memory, and storage device to input the musical score elements of the written or printed musical score as musical score elements input into the memory of the computer. The processor of the computer may receive the musical score elements input and execute musical score conversion computer code in the memory of the computer to convert the musical score elements input into elements of a musical score data structure 100. The musical score data structure 100 may be recorded on the storage device of the computer.

Conversion of a musical score to a musical score data structure 100 may be performed by musical score conversion computer code. Musical score conversion computer code according to embodiments of the present invention may be executed by a processor of a computer to parse musical score elements of an electronic musical score document stored on a storage device of the computer and convert the parsed musical score elements into elements of a musical score data structure 100. The musical score data structure 100 may be recorded on the storage device of the computer.

Figure 4:
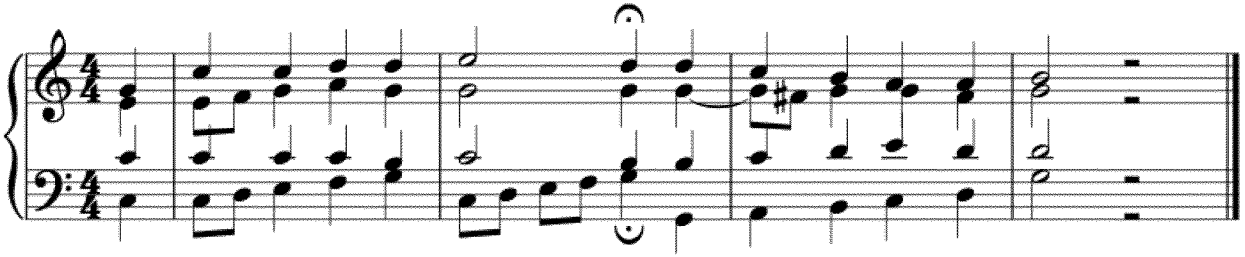
FIG. 4 illustrates the notation of a musical score.

FIG. 4 illustrates the notation of a musical score excerpted from the start of Bach's chorale In Allen meinen Taten. The musical score of FIG. 4 is notated using two staffs of music, where each staff is a set of 5 lines. Clefs, key signatures, bar divisions, and notes are also notated conventionally.

For the musical score of FIG. 4, the composition was written for a church choir consisting of four performing singing voices: Soprano (high female voice), Alto (low female voice), Tenor (high male voice), and Bass (low male voice). The treble (top) staff contains the music for the Soprano and Alto voices; the notes with their stems (lines) pointing upward are to be sung by the Soprano and the notes with stem directions down are to be sung by the Alto. In an analogous fashion, the bottom (bass) staff contains the music for the Tenor voice (stems up) and the Bass voice (stems down).

Consequently, conversion of the musical score of FIG. 4 to a musical score data structure results in four part records. For example, the Soprano part of the musical score may be converted to a Soprano part record having a name "Soprano"; an instrument assignment "voice"; a melodic line identifier corresponding to treble-staff notes with stems pointing upward; and a staff identifier corresponding to the treble staff. The Soprano part record contains score data records associated with the melodic line represented by the Soprano part of the musical score. Barline data records, clef data records, key data records, meter data records, note data records, and tempo data records are all generated in accordance with corresponding barlines, clefs, keys, meters, notes, and tempos as illustrated in FIG. 4 within the Soprano part of the musical score. Part Alto, Tenor, and Bass part records may be generated similarly.

The musical score represented by the musical score data structure 100 may be classified as a type 1 score or a type 2 score. A musical score may be classified as a type 1 score if each part of the musical score sounds only one note at any one time. A musical score may be classified as a type 2 score if any part of the musical score sounds more than one note at any one time.

According to embodiments of the present invention, during a step 320 of the tonal analysis method 300, the musical score data structure 100 may be parsed by the following steps.

According to a time ordering step of the step 320, the note data records associated with a staff are visited in time order. Each note data record visited is associated with a measure having an immediately preceding barline data record and an immediately succeeding barline data record in time order. In accordance with a time signature data associated with the staff, a starting beat time is recorded for each note data record based on the time order of that note data record relative to the immediately preceding barline data record and the immediately succeeding barline data record.

Figure 5A:
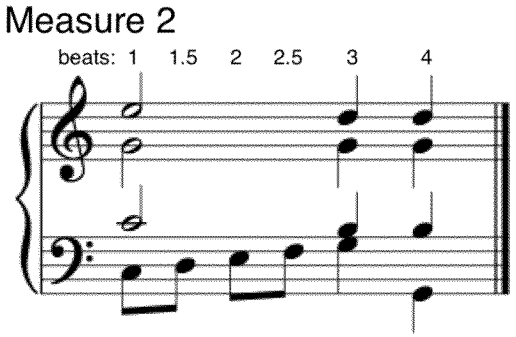
FIG. 5A illustrates the analysis of starting beat times of notes of a measure of the musical score of FIG. 4 by a step of the tonal analysis method of FIG. 3.

FIG. 5A illustrates the starting beat times recorded for the second measure of the musical score of FIG. 4. Starting beat times within this measure are 1, 1.5, 2, 2.5, 3, and 4 since eighth notes are sounded during the first and second beats, but only quarter notes are sounded during the third and fourth beats.

According to a timeline construction step of the step 320, a timeline of starting beat times recorded over a staff is generated by determining the union of all starting beat times recorded over a staff. The timeline includes each unique starting beat time within each measure of the staff.

Figure 5B:
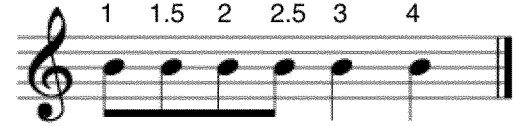
FIG. 5B illustrates the union of starting beat times of notes of a measure of the musical score of FIG. 4 by a step of the tonal analysis method of FIG. 3.

FIG. 5B illustrates the generation of a timeline of starting beat times for the second measure of the musical score of FIG. 4.

According to a sonority generation step of the step 320, for each starting beat time, a sonority data structure is generated by sampling all sounding notes at that starting beat time. For each starting beat time, a sonority data structure is created containing a time value matching the starting beat time. Each note data record having a time value matching the starting beat time is recorded in or associated with the sonority data structure. Each note data record having a combination of a time value and a note value indicating a note that started sounding before the starting beat time but sounds through the starting beat time is also recorded in or associated with the sonority data structure. For each sonority data structure, a note value is recorded in the sonority data structure corresponding to the smallest note value for a note data record recorded in or associated with the sonority data structure.

Figure 5C:
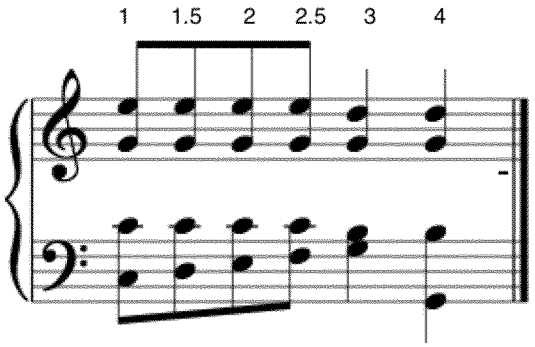
FIG. 5C illustrates the sampling of sounding notes for each starting beat time of a measure of the musical score of FIG. 4 by a step of the tonal analysis method of FIG. 3.

FIG. 5C illustrates the sampling of sounding notes for the second measure of the musical score of FIG. 4. The sonorities illustrated are numbered 7, 8, 9, 10, 11, and 12 of the sonorities of the musical score. The half notes of the measure are sampled to generate eighth notes. The eighth notes and quarter notes of the measure are unchanged.

According to a pitch class reduction step of the step 320, for each sonority data structure, a relative metric stress level of the sonority is determined, and the notes of the sonority are reduced to pitch class set notes. The pitch class set notes of the sonority may refer to the notes of the sonority remaining after removing all octave displacements from the notes of the sonority and removing all duplicate notes from the notes of the sonority while preserving the lowest sounding note of the sonority.

Figure 5D:
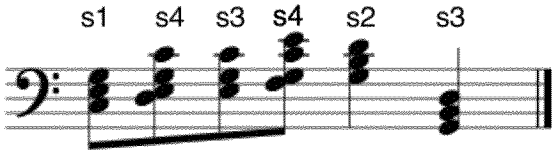
FIG. 5D illustrates the determination of relative metric stress levels and the generation of pitch class sets of a measure of the musical score of FIG. 4 by a step of the tonal analysis method of FIG. 3 by a step of the tonal analysis method of FIG. 3.

FIG. 5D illustrates the determination of relative metric stress levels and the generation of pitch class sets for the second measure of the musical score of FIG. 4. The sonority labeled "s1" has the strongest stress (downbeat); the sonority labeled "s2" has strong stress; the sonorities labeled "s3" have a beat stress; and the sonorities labeled "s4" have the weakest (off-the-beat) stress level.

According to a chord lookup step of the step 320, for each sonority data structure, the pitch class set notes of the sonority are converted to an interval set. An interval set describes the number of half-steps between pitch classes in a chord. An interval set is then classified with a chord identity by matching the interval set against a chord dictionary. A chord dictionary may be a data structure containing a group of chord records each containing a chord identity and an interval associated with that chord identity. A chord identity may specify the type of a chord as a triad chord, seventh chord, or any other known chord type. A chord identity may specify the quality of a chord as major or minor. A chord identity may specify the position of a chord as root or inverted. A chord identity may specify the root note of a chord.

Table 1 lists the chord records of a chord dictionary according to an embodiment of the present invention.

| Chord identity | Interval |
|---|---|
| Diminished triad in root position | (m3, m3) |
| Diminished triad in first inversion | (m3, A4) |
| Diminished triad in second inversion | (A4, m3) |
| Minor triad in root position | (m3, M3) |
| Minor triad in first inversion | (M3, P4) |
| Minor triad in second inversion | (P4, m3) |
| Major triad in root position | (M3, m3) |
| Major triad in first inversion | (m3, P4) |
| Major triad in second inversion | (P4, M3) |
| Augmented triad in root position | (M3, M3) |
| Augmented triad in first inversion | (M3, d4) |
| Augmented triad in second inversion | (d4, M3) |
| Diminished seventh in root position | (m3, m3, m3) |
| Diminished seventh in first inversion | (m3, m3, A2) |
| Diminished seventh in second inversion | (m3, A2, m3) |
| Diminished seventh in third inversion | (A2, m3, m3) |
| Half-diminished seventh in root position | (m3, m3, M3) |
| Half-diminished seventh in first inversion | (m3, M3, M2) |
| Half-diminished seventh in second inversion | (M3, M2, m3) |
| Half-diminished seventh in third inversion | (M2, m3, m3) |
| Minor-minor seventh in root position | (m3, M3, m3) |
| Minor-minor seventh in first inversion | (M3, m3, M2) |
| Minor-minor seventh in second inversion | (m3, M2, m3) |
| Minor-minor seventh in third inversion | (M2, m3, M3) |
| Major-minor seventh in root position (M3, m3, m3)! | (M3, m3, m3) |
| Major-minor seventh in first inversion | (m3, m3, M2) |
| Major-minor seventh in second inversion | (m3, M2, M3) |
| Major-minor seventh in third inversion | (M2, M3, m3) |
| Major-major seventh in root position | (M3, m3, M3) |
| Major-major seventh in first inversion | (m3, M3, m2) |
| Major-major seventh in second inversion | (M3, m2, M3) |
| Major-major seventh in third inversion | (m2, M3, m3) |
| Italian augmented sixth in root position | (d3, M3) |
| Italian augmented sixth in first inversion | (M3, A4) |
| Italian augmented sixth in second inversion | (A4, d3) |
| German augmented sixth in root position | (d3, M3, m3) |
| German augmented sixth in first inversion | (M3, m3, A2) |
| German augmented sixth in second inversion | (m3, A2, d3) |
| German augmented sixth in third inversion | (A2, d3, M3) |
| French augmented sixth in root position | (M3, d3, M3) |
| French augmented sixth in first inversion | (d3, M3, M2) |
| French augmented sixth in second inversion | (M3, M2, M3) |
| French augmented sixth in third inversion | (M2, M3, d3) |
| Swiss augmented sixth in root position | (m3, d3, M3) |
| Swiss augmented sixth in first inversion | (d3, M3, A2) |
| Swiss augmented sixth in second inversion | (M3, A2, m3) |
| Swiss augmented sixth in third inversion | (A2, m3, d3) |
| Major-minor seventh without fifth in root position | (M3, d5) |
| Major-minor seventh without fifth in first inversion | (d5, M2) |
| Major-minor seventh without fifth in second inversion | (M2, M3) |
| Diminished seventh without third in root position | (d5, m3) |
| Diminished seventh without third in second inversion | (m3, A2) |
| Diminished seventh without third in third inversion | (A2, d5) |
| Half-diminished seventh without third in root position | (d5, M3) |
| Half-diminished seventh without third in first inversion | (M3, M2) |
| Half-diminished seventh without third in second inversion | (M2, d5) |

The composition of chord records in a chord dictionary may be a subset of known chord identities in music theory and intervals associated with those chord identities in music theory. For example, a chord dictionary according to an embodiment of the present invention may include triad chords and intervals associated therewith; partial triad chords and intervals associated therewith; seventh chords and intervals associated therewith; and partial seventh chords and intervals associated therewith. A partial chord may be composed of the notes of a chord excluding, for example, the root, the third, the fifth, the seventh, or any subset thereof.

If an interval set matches against an interval associated with a chord identity in the chord dictionary, then the interval set may be classified by recording the associated chord identity in the sonority data structure of the interval set. The interval set is further classified by analyzing whether a note of the chord is doubled. The interval set is further classified by assigning the root and each interval of the interval set to a voice.

If an interval set does not match against any interval in the chord dictionary, then the interval set may be classified by recording an unclassified identity in the sonority data structure of the interval set.

Figure 6:
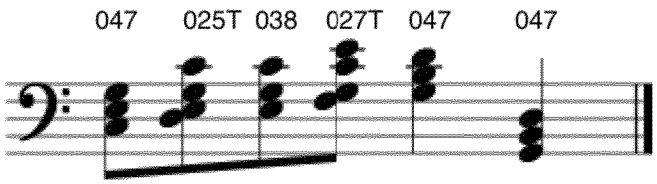
FIG. 6 illustrates the results of interval set classification of a measure of the musical score of FIG. 4.

FIG. 6 illustrates the results of interval set classification for the second measure of the musical score of FIG. 4. The interval sets are labeled as follows:

047: Major chord in root position

025T: Not a chord

038: Major chord in first inversion

027T: Not a chord

Table 2 lists the findings of step 320 of the tonal analysis method 300 for the second measure of the musical score of FIG. 4 after the interval sets labeled as 047 and 038 are further classified.

| Sonority | Beat | Stress | Chord | Inversion | Root | Doubling |
|---|---|---|---|---|---|---|
| 7 | 1 | Downbeat | Major | Root | C | Root |
| 8 | 1.5 | Off-the-beat | — | — | — | — |
| 9 | 2 | Beat | Major | First | C | Third |
| 10 | 2.5 | Off-the-beat | — | — | — | — |
| 11 | 3 | Strong-beat | Major | Root | G | Root |
| 12 | 4 | Beat | Major | Root | G | Root |

According to embodiments of the present invention, during a step 330 of the tonal analysis method 300, non-harmonic tones of the musical score may be classified by the following steps.

Each of the notes of a sonority having an unclassified identity is tested to determine whether it is a non-harmonic tone. A non-harmonic tone may be a note of a sonority that plays no part in a theory of inversion of any triad or seventh chord of that sonority.

Each tone in the sonority having an unclassified identity is tested against a target sonority. The nature of the target sonority depends on whether the sonority having an unclassified identity has a weak or strong relative metric stress level.

If the sonority having an unclassified identity has a weak relative metric stress level, then the target sonority for the sonority having an unclassified identity may be the position-wise nearest sonority to the left having a stronger relative metric stress level; in a first weak test, each tone in the sonority having an unclassified identity is tested to determine whether that tone is in the set of harmonic tones of the target sonority; in a second weak test, each tone in the sonority having an unclassified sonority is tested to determine whether that tone complements an incomplete harmony of the target sonority; and in a third weak test, each tone in the sonority having an unclassified sonority is tested to determine whether that tone was previously classified as a non-harmonic tone. If a tone is not in the set of harmonic tones of the target sonority, does not complement an incomplete harmony of the target sonority, and has not been classified as a non-harmonic tone, that tone is classified as a non-harmonic tone.

If the sonority having an unclassified identity has a strong relative metric stress level, then the target sonority for the sonority having an unclassified identity may be the position-wise nearest sonority to the right having a weaker relative metric stress level; in a first strong test, each tone in the sonority having an unclassified identity is tested to determine whether that tone is a momentary tone (one that does not appear in the previous sonority and does not last a full beat); and in a second strong test, each tone in the sonority having an unclassified identity is tested to determine whether that tone is a stale tone (a dissonant tone that appears in the previous sonority as a consonant tone). Each momentary tone and each stale tone in the sonority having an unclassified identity is further tested by substituting it with an equivalent tone in the target sonority, and the resulting substituted interval set of the sonority is matched against the chord dictionary. If the substituted interval set of the sonority matches against an interval associated with a chord identity in the chord dictionary, then that substituted momentary tone or the substituted stale tone is classified as a non-harmonic tone.

Figure 7A:
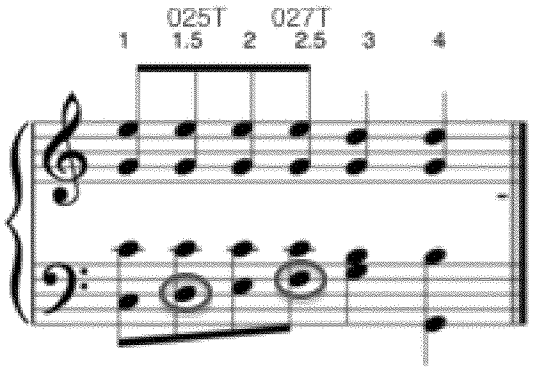
FIGS. 7A and 7B illustrate the results of non-harmonic tone classification for measures of the musical score of FIG. 4 by a tonal confirmation step of the tonal analysis method of FIG. 3.

FIG. 7A illustrates the results of non-harmonic tone classification for the second measure of the musical score of FIG. 4. Weak tests are used because both sonorities having unclassified identities have weak relative metric stress levels in this measure.

The unclassified sonority 025T (numbered 8) is at beat 1.5 and 027T (numbered 10) is at 2.5; the target sonority for 025T (numbered 7) is at beat 1 and the target sonority for 027T (numbered 9) is at beat 2. For the chord of sonority 8, all the notes but the D in the bass belong to the chord of target sonority 7; therefor the note D is a non-harmonic tone and the underlying harmony for beat 1.5 is the same as beat 1, and so the chord of sonority 8 is now classified as a major chord in root position.

In a similar fashion, all the notes in the unidentified chord of sonority 10 are also in the chord of its target sonority 9, so the bass note F at the chord of sonority 10 is a non-harmonic tone and the underlying harmony for beat 2.5 and so the chord of sonority 10 is now classified as a major chord in first inversion.

Figure 7B:
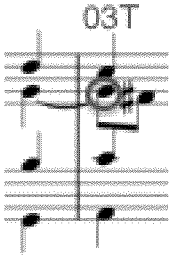

FIG. 7B illustrates the results of non-harmonic tone classification for the first sonority of the third measure of the musical score of FIG. 4. Strong tests are used because the sonority has a strong relative metric stress level in this measure.

The interval set of the downbeat sonority is 03T, which is not a chord. However, the circled note (G) is a momentary tone and substituting its successor tone (F#) into the sonority produced the interval set 036, which the chord dictionary classifies as a Diminished triad in first inversion.

If the musical score is classified as a type 2 score, step 330 now ends. If the musical score is classified as a type 1 score, next, for each non-harmonic tone, a melodic interval set is generated. The melodic interval set for a non-harmonic tone includes the non-harmonic tone itself, the tone of the antecedent sonority associated with the same voice as the non-harmonic tone, and the tone of the successor sonority associated with the same voice as the non-harmonic tone.

Additionally, for each seventh tone of a chord of a sonority, a melodic interval set is generated. The melodic interval set for a seventh tone includes the seventh tone itself, the tone of the antecedent sonority associated with the same voice as the seventh tone, and the tone of the successor sonority associated with the same voice as the seventh tone.

Next, each melodic interval set of a non-harmonic tone and each melodic interval set of a seventh tone is matched against a non-harmonic tone model dictionary. A non-harmonic tone model dictionary may be a data structure containing a group of non-harmonic tone records each containing a non-harmonic tone identity and a melodic interval associated with that tone identity. A non-harmonic identity may specify the role of a non-harmonic tone as a passing tone, a neighbor tone, a changing tone, an anticipation, an incomplete neighbor tone, a suspension (7-6, 4-3, 2-3, 2-1), a ritardation, or any other known non-harmonic tone role. A non-harmonic tone identity may specify a non-harmonic tone as upward or downward.

If a melodic interval set matches against a melodic interval associated with a non-harmonic tone identity in the non-harmonic tone model dictionary, then the melodic interval set is classified by recording the associated non-harmonic tone identity in the sonority data structure of the melodic interval set.

Figure 8A:
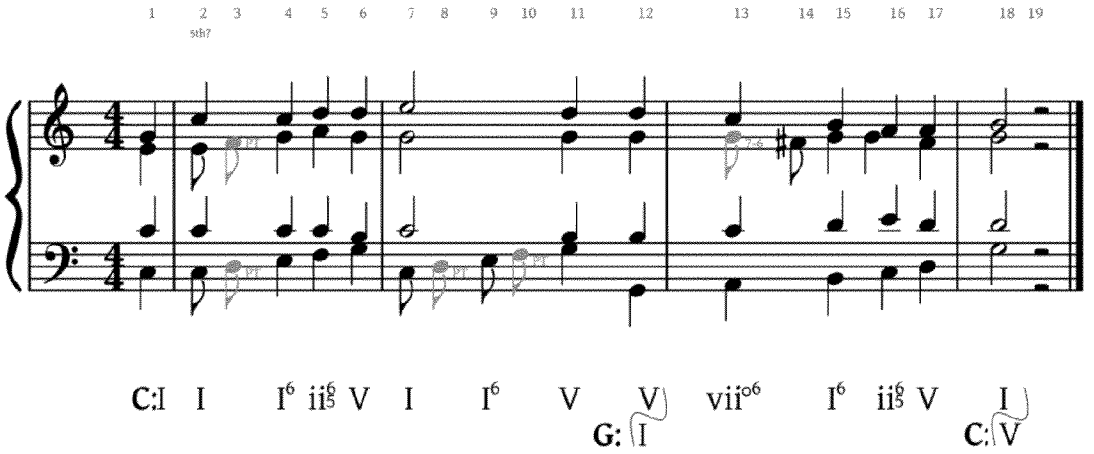
FIGS. 8A and 8B illustrate the output of sonority classification and non-harmonic tone classification by steps of the tonal analysis method of FIG. 3 with regard to the entire musical score of FIG. 4.
Figure 8B:
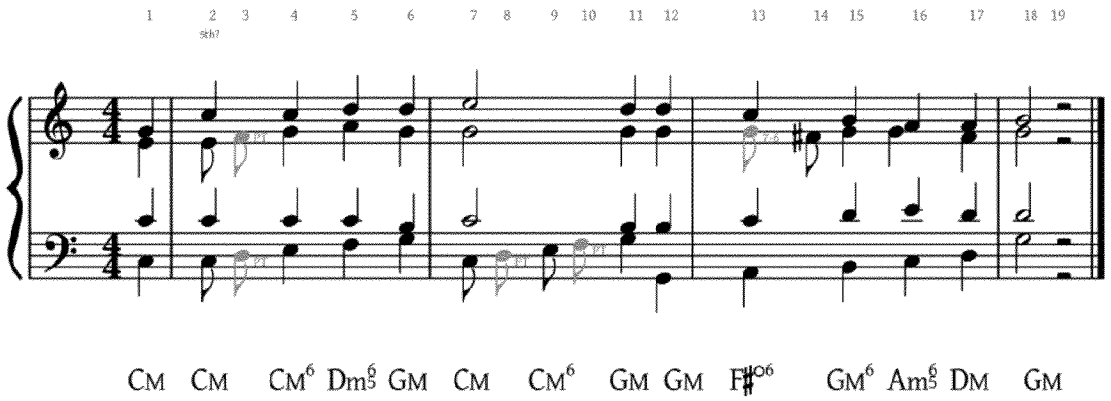

FIGS. 8A and 8B illustrate the output of sonority classification and non-harmonic tone classification in steps 320 and 330 with regard to the entire musical score of FIG. 4. Sonority classification determines the root, chord type and inversion of each chord of a sonority, and non-harmonic tone classification determines the melodic role of each non-harmonic tone (lightly outlined). These results are displayed using music notation and the symbols under each sonority provide the chord classification. The symbols may be displayed using a chord notation system. FIG. 8A displays the symbols using Roman numeral notation. FIG. 8B displays the symbols using chord symbol notation. For example, in FIG. 8B, the classification "Cm" under sonority 1 means "C-major triad in root position", and the classification "Am65" under sonority 16 means "A-minor seventh chord in first inversion."

According to embodiments of the present invention, during a step 340 of the tonal analysis method 300, tonal centers of the musical score may be identified and functional theories of the musical score may be constructed by the following steps.

For each sonority, a test pair is generated. The test pair includes the sonority itself and the position-wise nearest sonority to the right having a root different from the root of the sonority. The test pair is then tested for tonal center confirmation. A tonal center is confirmed by the test pair with the sonority to the right as the tonal confirmation point, if a chord of the test pair implies a tonal center tone, and if the implied tonal center tone is touched.

A tonal center tone is implied by a dominant seventh chord or a chromatically altered major chord, any sort of diminished chord. If a chord of the test pair is a dominant seventh chord, the implied tonal center tone is a perfect fifth below the root of the chord. If a chord of the test pair is a diminished chord, the implied tonal center tone is one half step above the root of the chord. A tonal center may be a home tonal center of the musical score if the tone of the tonal center is the home key of the musical score.

An implied tonal center tone is touched if the implied tonal center tone is the root of a major or minor chord preceded by either a major chord a perfect fifth above or by a diminished chord a minor second below.

A test pair implies a tonal center tone that is touched under each of the following conditions:

Rule 1: The test pair includes a major-minor-seventh chord (dominant seventh) whose root moves a fifth down or fourth up to a major or minor triad (in music theory notation $V^7 \rightarrow I$ or $V^7 \rightarrow i$);

Rule 2: The test pair includes a dominant function chord (e.g., any of the chords: V, $V^7$, vii (diminished), $vii^7$ (diminished/half diminished)) followed by a tonic function chord (e.g. any of the chords I, i, VI, vi), with the following possible root motions: (1) V or $V^7$ to the I or i by perfect fifth; (2) V or $V^7$ to vi by whole step; (3) V or $V^7$ to VI by half-step; (4) vii or $vii^7$ to I or i by half-step.

Rule 3: The test pair includes a major triad falling a perfect 5th to a major or minor triad at the end of a section of music or to a chord marked by a fermata ($V \rightarrow I$ or $V \rightarrow i$), or to the tonic triad of the home key (main key) of the composition (a "touched structural cadence");

Rule 4: The test pair includes a touched successor from a structural cadence, i.e. $V \rightarrow I$ with V being a structural cadence point (at the end of a section of music or a chord marked by a fermata).

Figure 9:
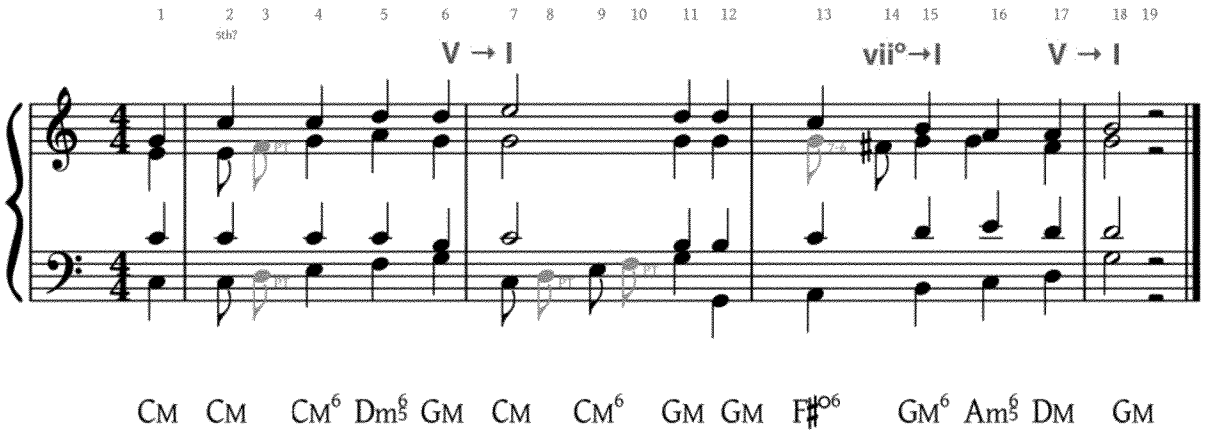
FIG. 9 illustrates the output of tonal center confirmation by a step of the tonal analysis method of FIG. 3.

FIG. 9 illustrates the output of tonal center confirmation during step 340. A first tonal center confirmation is located at sonorities 6-7 and confirms tonal center C (major) by rule 3. A second tonal center confirmation at sonorities 15-16 confirms tonal center G (major) by rule 1. A third tonal center confirmation at sonorities 17-18 confirms G (major) by rule 3.

Next, a functional theory for the musical score is constructed by a number of steps. For each confirmed tonal center, a theory line is defined by the region of the musical score spanning each confirmation of that tonal center. Each functional theory construction step may include one or more accountings of each chord of the musical score to identify the function of the chord for a confirmed tonal center. Each theory line for a confirmed tonal center may include one or more tonally stable regions such that the chords of each pair of adjacent sonorities in a tonally stable region are both accounted as functional symbols of that tonal center.

To perform an accounting for a chord for a confirmed tonal center, the interval between the root tone of the sonority and the tone of the confirmed tonal center is found, and the interval and the tone of the confirmed tonal center are then matched against a tonal center dictionary. A tonal center dictionary may be a data structure containing a group of chord model records each containing a scale degree for a tonal center tone, and one or more chord models associated with that scale degree. A scale degree may be, for example, a diatonic or a chromatic variant of a tonic scale degree, a supertonic scale degree, a median scale degree, a subdominant scale degree, a dominant scale degree, a submediant scale degree, or leading tone scale degree of the confirmed tonal center. A tonic scale degree for a confirmed tonal center C, for example, may be associated with the chord models: C-major triad, C-minor triad, C-major seventh, and C-minor seventh.

Table 3 lists the chord model records of a tonal center dictionary according to an embodiment of the present invention.

| Scale degree | Chord models |
|---|---|
| Tonic scale degree chords | major triad, minor triad, major-major seventh, minor-minor seventh |
| Lowered supertonic scale degree chords | major (Neapolitan) triad, major-major seventh |
| Diatonic supertonic scale degree chords | minor triad, diminished triad, minor-minor seventh, half-diminished seventh, French augmented-sixth |
| Raised supertonic scale degree chords | Swiss augmented-sixth |
| Lowered mediant scale degree chords | augmented triad, major triad, augmented-major seventh, major-major seventh |

-continued

| Scale degree | Chord models |
|---|---|
| Diatonic mediant scale degree chords | minor triad, minor seventh |
| Diatonic subdominant scale degree chords | major triad, minor triad, major-major seventh, minor-minor seventh |
| Raised subdominant scale degree chords | Italian augmented-sixth, German augmented-sixth |
| Diatonic dominant scale degree chords | major triad, minor triad, major-minor seventh, minor-minor seventh |
| Lowered submediant scale degree chords | major triad, major-major seventh |
| Diatonic submediant scale degree chords | minor triad, diminished triad, minor-minor seventh, half-diminished seventh |
| Lowered seventh scale degree chords | major triad |
| Leading tone scale degree chords | diminished triad, half-diminished seventh, diminished seventh |

For a confirmed tonal center, if the interval between the root tone of the sonority and the tone of the confirmed tonal center matches a scale degree of a tonal center tone which matches the tone of the confirmed tonal center, then the chord of the sonority is matched against the chord models associated with that scale degree. If a chord of a sonority matches against a chord model associated with the scale degree, then the chord of that sonority is accounted as a functional symbol of the confirmed tonal center.

In a first functional theory construction step (rule 1), the chord of the first sonority of the musical score and the chord of the final sonority of the musical score are accounted. If the accounting of the chord of the first sonority matches the chord of the sonority against a chord model associated with a scale degree of a tonal center tone which is the home key of the musical score, then the chord of the first sonority is accounted as a functional symbol of the home tonal center of the musical score. If the accounting of the chord of the final sonority matches the chord of the sonority against a chord model associated with a scale degree of a tonal center tone which is the home key of the musical score, then the chord of the final sonority is accounted as a functional symbol of the home tonal center of the musical score.

In a next functional theory construction step (rule 2), each pair of adjacent confirmations of a confirmed tonal center is identified. The region between the tonal confirmation points of the pair of adjacent confirmations of a confirmed tonal center is claimed as a tonally stable region for that confirmed tonal center. Each chord within a tonally stable region is accounted as a functional symbol of the confirmed tonal center.

In a next functional theory construction step (rule 3), for each chord of a sonority identified as a structural cadence, a tonal center at that sonority is asserted as confirmed. For each chord of a sonority to the right of a structural cadence that is not within a tonally stable region, the chord is accounted as a functional symbol of the tonal center at the sonority identified as a structural cadence unless the accounting of the chord as a functional symbol of the home tonal center of the musical score passes a strength test, in which case the chord is accounted as a functional symbol of the home tonal center. The accounting of the chord as a functional symbol of the home tonal center passes the strength test if the diatonic length of the home tonal center can account for the chords and is made even stronger if a match is made against the tonic chord during the home tonal center accounting.

In a next functional theory construction step (rule 4), for each region of the musical score not accounted or claimed and bordered by a common tonal center on either side, attempt to account each chord of a sonority in the region with the inclusion of a secondary dominant for that tonal center. If each chord of a sonority in the region is accounted as a functional symbol of that tonal center by the inclusion of a secondary dominant for that tonal center, claim the region as a tonally stable region for that tonal center.

In a next functional theory construction step (rule 5), for each region of the musical score not accounted or claimed and bordered by different tonal centers on each side, or bordered by a common tonal center on each side but not claimed in the previous step, attempt to account each chord of a sonority in the region starting from the leftmost chord as a functional symbol of the tonal center bordering on the left until a chord fails to be accounted, and claim the region encompassing each chord thus accounted as a tonally stable region for the tonal center bordering on the left. Then, attempt to account each of the remaining chords starting from the rightmost chord as a functional symbol of the tonal center bordering on the right until a chord fails to be accounted, and claim the region encompassing each chord thus accounted as a tonally stable region for the tonal center bordering on the right.

In a next functional theory construction step (rule 6), for each chord that was accounted as a functional symbol of both bordering tonal centers during the previous step, that chord is classified as a pivot chord.

In a next functional theory construction step (rule 7), for each region of the musical score not accounted or claimed, if the entire region is spanned by a theory line, and the region includes at least one tonicized chord, attempt to account each chord of a sonority in the region as a functional symbol of the tonal center corresponding to the spanning theory line.

In a next functional theory construction step (rule 8), for each region of the musical score not accounted or claimed, attempt to account each chord of a sonority in the region as a functional symbol by merging any tonicizations from other keys into those unclassified sonority positions (gap) and then attempting to account for the other unclaimed positions as belonging to the same key.

Figure 10:
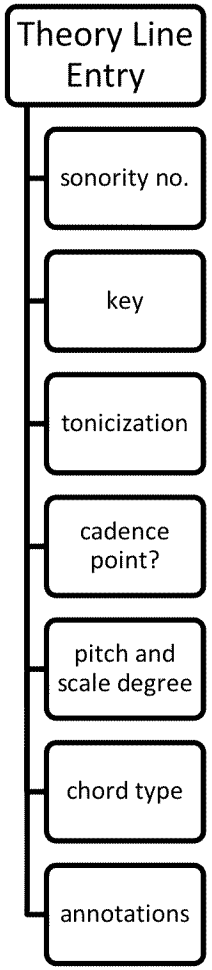
FIG. 10 illustrates a Theory Line Entry data structure according to an embodiment of the present invention.

Following all functional theory construction steps, each chord of a sonority not accounted is classified as an unsolved chord. For each sonority, a Theory Line Entry data structure is generated. FIG. 10 illustrates a Theory Line Entry data structure, which may store the types of information uncovered in the analysis for a given sonority, including the sonority number, the current key and possible tonicization classifications (e.g., direct tonicization, pivot chord, etc.), cadence points, pitch and scale degree of chord root, the triad and seventh chord type (all combinations of major minor diminished and augmented), and an array holding any annotations.

Figure 11:
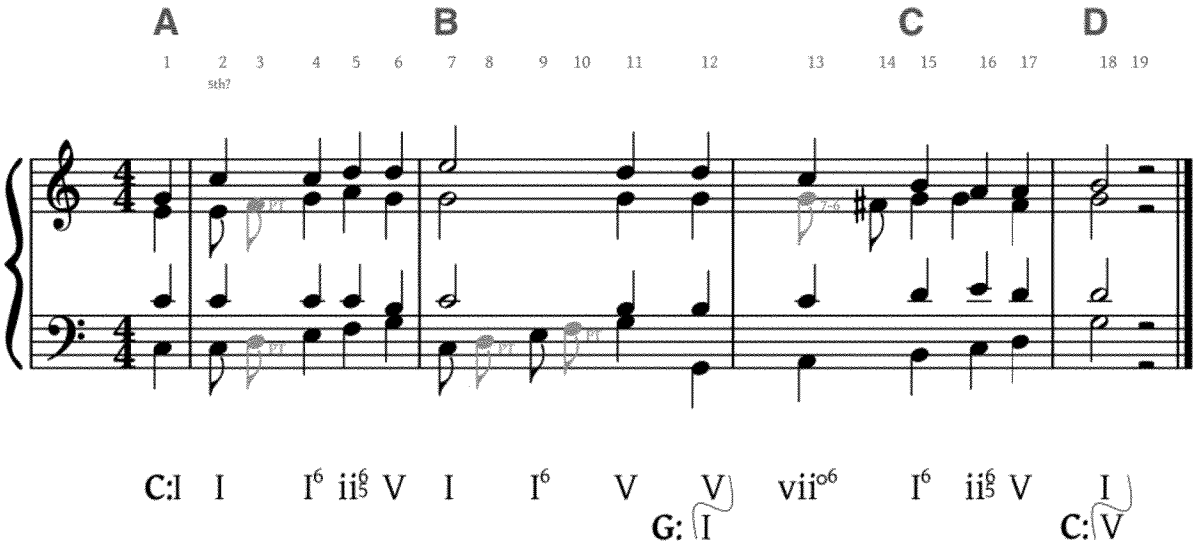
FIG. 11 illustrates the output of all functional theory construction steps of the tonal analysis method of FIG. 3 with regard to the entire musical score of FIG. 4.

FIG. 11 illustrates the output of all functional theory construction steps with regard to the entire musical score of FIG. 4. Points of tonal center confirmations are marked with letters A, B, C, and D. The tonal centers and the regions between each adjacent pair of confirmed tonal centers are accounted or claimed as follows:

A to B (sonority 1 to 7): Left side A is home key C-major and right side B is tonal center confirmation of C-major. Uses rule 1 to account for all symbols between A and B using C-major.

B to C (sonority 7 to 15): Left side B is C-major, right side C is tonal center confirmation of G-major. Uses Rule 5 as follows: slide A (C-major) rightward and C (G-major) leftward as long as chords belong to their respective tonal dictionaries. Sonorities 7-12 belong to C-major and chords 7-15 belong to G major. Use rule 5 to identify the latest shared chord at sonority 12 as being a pivot chord between the two keys.

C to D (sonority 15 to 18): Left side C is tonal confirmation of G-major, right side D is structural tonal center confirmation of G-major. Uses rule 2 to account for all the chords as belonging to G major.

D (sonority 18): Use rule 1 to claim chords 15-18 as as belonging to the home key C-major. Use latest chord to provide pivot point between previous G-major at C and C-major at D. This effectively marks the last chord as being the dominant of the home key.

According to embodiments of the present invention, during a step 350 of the tonal analysis method 300, errors and stylistic anomalies may be identified and annotations may be generated by the following steps.

In an error and stylistic anomaly identification step, for each sonority, if an error condition is true for that sonority, an error annotation is generated containing a textual explanation of the error condition. Each error annotation is a data structure that contains a severity level (importance), a classification (error type), a label (text name), an explanation (text commentary) and a color. A severity level of an error annotation may be graphically distinguished on the score by a unique color. A severity level may have one of the following values:

An error annotation having an "error" severity level documents an issue that is unambiguously incorrect, such as a sonority that is not a chord, or a voice-leading issue such as parallel octaves. According to an embodiment of the present invention, an error annotation having an "error" severity level may be displayed in red.

An error annotation having a "warning" severity level documents an issue that is possibly (but not necessarily) wrong depending on context, for example musical parts that are too high in their range, or above or below other voices in atypical ways. According to an embodiment of the present invention, an error annotation having a "warning" severity level may be displayed in orange.

An error annotation having a "notification" severity level documents an issue that might be anomalous but not wrong, such as a chord that is missing its 5th, or a root position chord that doubles its third. According to an embodiment of the present invention, an error annotation having a "notification" severity level may be displayed in purple.

An error annotation having a "comment" severity level may be documentation added by a teacher to explain something in the score not covered by the automatic annotation software. According to an embodiment of the present invention, an error annotation having a "comment" severity level may be displayed in gray.

An error annotation having an "ignored" severity level may be temporarily hidden from display in the score while the severity level of the error annotation is set to "ignored." A hidden error annotation may be displayed if the severity level of the error annotation is set to a value other than "ignored."

A classification of an error annotation may have one of the following values:

An error annotation having a "spelling" classification documents an issue having to do with the construction of a chord; for example, the sonority is a triad or seventh, or it has improperly double tones, is missing a chord member such as the 5th or 3rd, etc.

An error annotation having an "analysis" classification documents an issue with user actions or input; for example a student enters an incorrect Roman number or inversion in the theory line while completing an analysis assignment.

An error annotation having a "voice" classification documents an issue with how a chord is distributed among the available voices or part; for example, voice crossing, voice overlap or range issues. Voice annotations are only attached to type 1 scores.

An error annotation having a "motion" classification documents an issue with how voices move from one sonority to the next; for example parallel octaves or direct fifths. Motion annotations are only attached to type 1 scores.

Table 4 lists error annotations by classification according to an embodiment of the present invention.

| Annotation classification | Annotations |
|---|---|
| Spelling | Unclassified Chord |
| | Missing Root of Chord |
| | Missing Third of Chord |
| | Missing Fifth of Chord |
| | Missing Seventh of Chord |
| | Doubled Leading Tone |
| | Doubled Seventh Tone |
| | Neapolitan 6th Atypical Inversion |
| | Augmented 6th Atypical Inversion |
| | Neapolitan 6th Bad Doubling |
| | Augmented 6th Bad Doubling |
| Analysis | Invalid Key |
| | Invalid Chord Type |
| | Invalid Chord Inversion |
| | Invalid Chord Root |
| | Invalid Scale Degree |
| | Invalid Tonicization |
| | Missing Answer |
| Motion | Parallel Octaves |
| | Parallel Fifths |
| | Parallel Unisons |
| | Direct Octaves |
| | Direct Fifths |
| | Direct Unisons |
| | Diminished Interval |
| | Augmented Interval |
| | Seventh Not Resolved |
| | Neapolitan 6th Bad Motion |
| | Augmented 6th Bad Motion |
| Voicing | Voice Crossing |
| | Voice Overlap |
| | Voice Range |
| | Voice Spacing |

According to embodiments of the present invention, during a step 360 of the tonal analysis method 300, an annotated graphical representation of the musical score may be generated by the following steps.

An annotated representation of a musical score may be generated including the musical score elements, as well as a theory line element and markup token elements. A theory line element is a representation of the contents of a Theory Line Entry using a chord notation. A theory line element may have more than one display mode each representing the contents of a Theory Line Entry using a different chord notation. A chord notation may be a Roman numeral notation, a figured bass notation, a chord symbol notation, a chord type notation, or an interval notation.

A markup token element is a representation of the contents of an error annotation using any combination of text labels, arrow lines, connecting lines between notes, and coloring of any of labels, lines, and notes where coloring corresponds to a severity level of an error annotation.

Figure 12A:
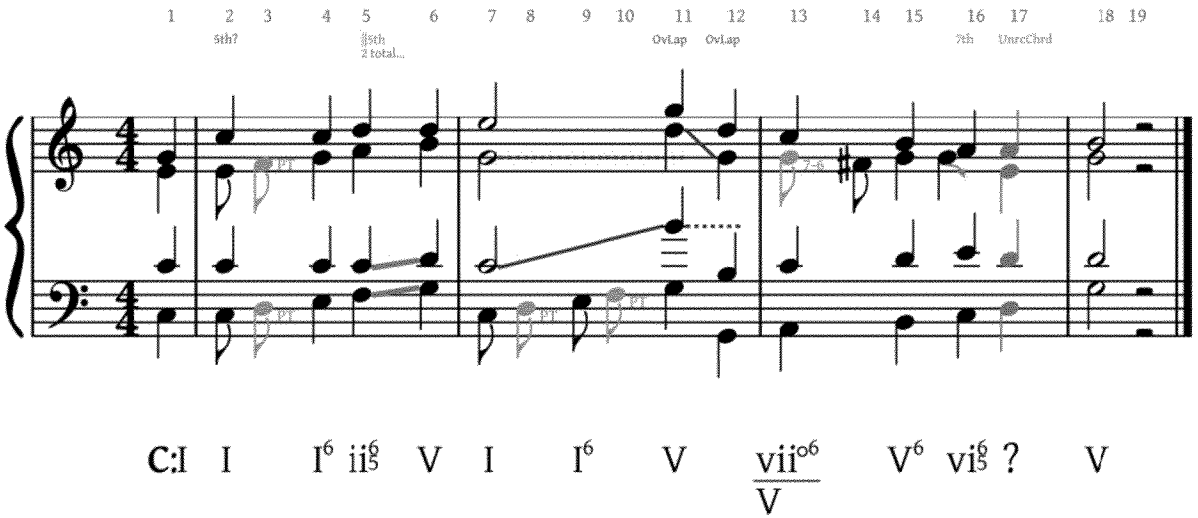
FIG. 12A illustrates an annotated representation of the musical score of FIG. 4.

FIG. 12A illustrates an annotated representation of the musical score of FIG. 4. FIGS. 12B through 12E illustrate possible theory line elements for the annotated representation of FIG. 12A with display modes using a Roman numeral notation, a figured bass notation, a chord symbol notation, and a chord type notation, respectively.

A human user may interact with a computer having a display, input device, processor, memory, and storage device to input information into a Theory Line Entry data structure. The processor of the computer may receive the user input in the memory of the computer and record the user input on the storage device of the computer in the Theory Line Entry data structure.

A teacher user may create an assignment based on a musical score by inputting assignment parameters based on the Theory Line Entry data structure of the musical score into a program of the present invention in teacher mode, and may input information into the Theory Line Entry data structure while creating an assignment. An assignment includes instructions to run the program of the present invention in student mode and run an assignment session wherein a student user may input information into a blank Theory Line Entry data structure in response to a question prompt from the program of the present invention. An assignment further includes instructions for the program of the present invention to grade the student user input by comparing the conformity of the input of a student user to an authority composition or analysis, and then deducting point values of error values from a total possible score, each set by a teacher user. The student input values are matched against authority composition or analysis values to identify values that do not agree. Specific point values are deducted for any student input that does not agree with the corresponding authority value.

The following kinds of score values participate in the grading of student input:

An automatic value is a value output by a step of the tonal analysis method.

An override value is a value input by a teacher user in teacher mode to take the place of an automatic value.

An authority value is the actual comparator value for judging student work. An authority value is an automatic value if no corresponding override value was input, or an override value if a teacher user input a corresponding override value.

A student value is a value input by a student user in student mode. The validity of the student value is determined by comparing (matching) it to an authority value.

A teacher user may set an assignment with a non-repeatable parameter or a repeatable parameter. In an assignment session, a non-repeatable parameter instructs the program of the present invention to display question prompts to a student user to input a theory line analysis (student value) or a music composition; receive student input; grade the student values in response to the student pressing a grade button; and then locks the assignment state to prevent subsequent input. An assignment having a non-repeatable parameter may be labeled as a homework assignment or a test assignment.

In an assignment session, a repeatable parameter instructs the program of the present invention to display question prompts to a student user to input a theory line analysis (student value) or a music composition (student value); receive student values; grade the student values in response to the student pressing a grade button; present the results of grading the student values to the student; and then allow the student to press a retake button to reset the assignment to its initial state so that the student can start a new assignment session. An assignment having a non-repeatable parameter may be labeled as a practice assignment.

A teacher user may set the assignment with a transposition factor. A non-repeatable or repeatable assignment loaded into the program of the present invention may instruct the program to generate randomly transposed question prompts according to a transposition factor set in teacher mode. This allows a repeatable assignment to display a new configuration of questions for each new assignment session (so it is not answered exactly the same way as the previous time) and also ensures that a non-repeatable assignment does not present the same question prompts for all student users (to cut down on cheating).

A teacher user may set the assignment with a time limit. A non-repeatable or repeatable assignment loaded into the program of the present invention may present question prompts to a student user only after the student user presses a start button to begin a timed answer period and begin a timer based on the set time limit. If the student user inputs student values for all question prompts of the assignment and presses the grade button before the timer elapses, the assignment session proceeds as above. If the student user has not input student values for all question prompts when the timer elapses, the assignment state is automatically locked and the assignment is graded using only the student values input when the timer elapsed.

An assignment may have a style determined by the subject matter of the question prompts of the assignment and the basis for grading the assignment. An analysis assignment may have question prompts for student users to input elements of a theory line analysis based on a musical score (student values), and the grading basis may be a comparison of an input theory line analysis (student values) against corresponding authority values. A composition assignment may have question prompts for student users to input elements of a musical score (such as adding notes, etc.) (student values), and the grading basis may be a comparison of an input musical score (student values) against corresponding authority values. A combination assignment may have question prompts for student users to input elements of a musical score (student values) and then input elements of a theory line analysis based on the input musical score (student values), and the grading basis may be an application of steps of the tonal analysis method to the input musical score (student values) to construct a functional theory, generate a Theory Line Entry data structure, and generate error annotations; a review of the error annotations to grade the input musical score (student values); and a comparison of an input theory line analysis (student values) against authority values of the Theory Line Entry data structure to grade the input theory line analysis (student values).

A matching process compares authority values to the corresponding student values input. A student value matches if it is the same as the corresponding authority value. Assignment grades are determined by comparing all student values to each corresponding authority value and then subtracting error deductions from the authority's points per entry. Points per entry is the maximum numerical amount each authority value is assigned by a teacher user. An error deduction is an amount subtracted from the points per entry when matching fails.

An error deduction may be an analysis deduction, for which the matching process compares a student Theory Line Entry input to the Theory Line Input authority value and subtracts the error deduction associated with each comparison.

An error deduction may be a composition deduction, for which the matching process collects each error annotation from an input musical score (student value) and subtracts the error deductions associated with each error annotation.

Figure 13:
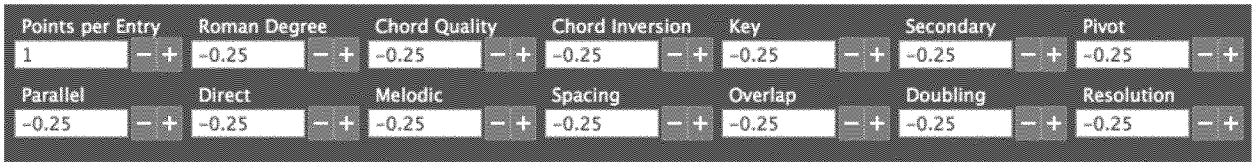
FIG. 13 illustrates a standard value allocation for authority points per entry and error deduction.

FIG. 13 illustrates a standard value allocation for authority points per entry and error deduction. A program of the present invention may have the illustrated default settings for points per entry and the various error deductions defined by the system. The top row displays analysis error deductions and the bottom row are errors in composition assignments. All values can be reset on a per/assignment basis by a teacher user in teacher mode.

Points per Entry: the total possible points for the composition or analysis value if no errors are deducted.

Roman Degree: the amount to deduct if the student's Roman letter (e.g. I, II, etc.) does not match the authority value.

Chord Quality: the amount to deduct if a chord quality student value (major, minor, etc.) does not match the corresponding authority value.

Chord Inversion: the amount to deduct if a chord inversion student value (e.g. root position, first inversion, etc.) does not match the corresponding authority value.

Key: the amount to deduct if a key student value (e.g. C-major, E-minor, etc.) does not match the corresponding authority value.

Secondary: the amount to deduct if a secondary letter student value (e.g. V7/III) does not match the corresponding authority value.

Pivot: the amount to deduct if a pivot symbol student value (e.g. vi=C:ii) does not match the corresponding authority value.

Parallel: the amount to deduct if a parallel octave or fifth is found in an input musical score.

Direct: the amount to deduct if a direct octave or fifth is found in an input musical score.

Figure 14:
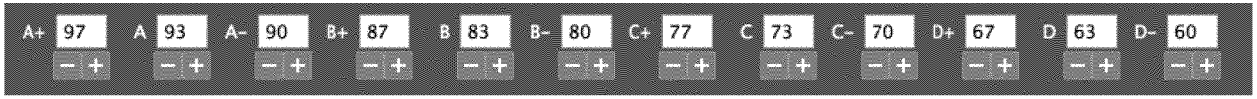
FIG. 14 illustrates a grading curve displaying a set of default values.

FIG. 14 illustrates a grading curve displaying a set of default values.

These values can be reset on a per-assignment basis by a teacher user in teacher mode.

Figure 15:
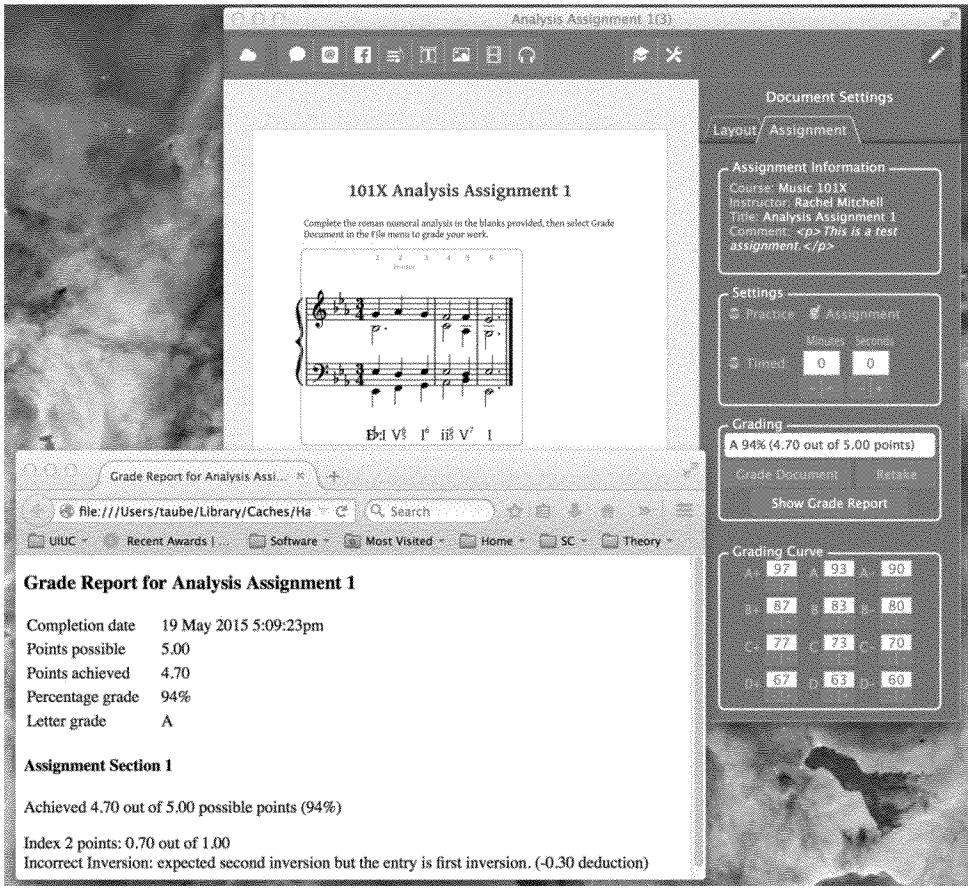
FIG. 15 illustrates results of automatic assignment grading.

FIG. 15 illustrates results of automatic assignment grading. Results are made visible on the score by way of error annotations with deductions and also in a detailed error report that is automatically generated and sent to the teacher user.

The total possible points for an assignment is the sum of all authority points per entry.

The total achieved points for an assignment is the sum of all points per entry minus the error deductions found in the student values.

The assignment percentage grade is equal to: achieved/possible*100.

The assignment letter grade is the percentage grade converted to a letter A+ . . . F based on an assignment grading curve established for the assignment by a user in teacher mode.

The assignment report is a detailed description of every points per entry and every error deduction, along with whatever error annotation was attached to it. The report is generated as HTML and sent to the class server for teacher oversight and statistical reporting on class averages.

The same matching algorithms that enables music to be graded also supports searching music scores for specific information. The search function operates by mapping over the theory line of score and collecting all TLEs that match a specific user query. The query is simply a special search TLE that holds the values the user wants to search for. Any value in the search TLE can be searched for in the score, e.g. its chord type, inversion, pitch, seventh type, Roman numeral, key, interval, or annotations. Individual queries can be combined into expressions involving boolean relationships of AND, OR and NOT.

Figure 16A:
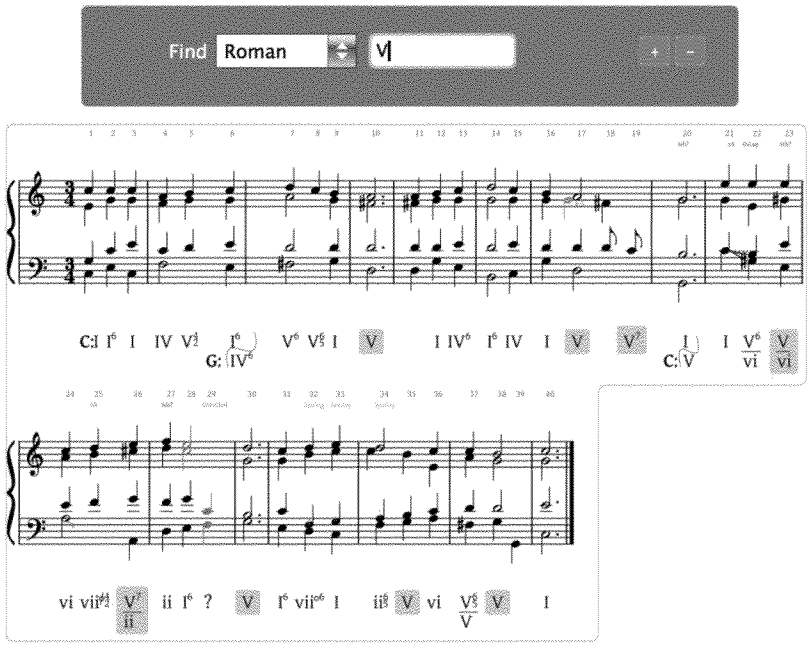
FIGS. 16A and 16B illustrate searching for analytical conditions in a musical score.
Figure 16B:
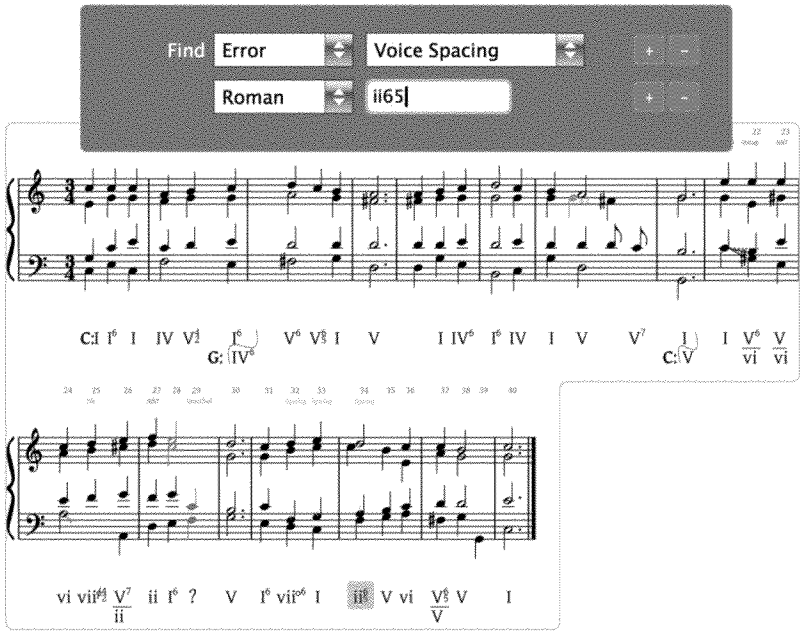

FIGS. 16A and 16B illustrate searching for analytical conditions in a musical score. FIG. 16B demonstrates a search expression that involves an AND of two search conditions.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

What is claimed is:

1. A tonal analysis method, comprising:

parsing notes of a musical score to generate a time-ordered plurality of sonorities, each sonority having a chord comprising a subset of notes of the musical score based on time value;

confirming a plurality of tonal centers each having a tone, each by testing a pair of sonorities among the plurality of sonorities;

accounting a chord of a sonority for a confirmed tonal center to determine whether the chord of the sonority is a functional symbol of the confirmed tonal center; and identifying a tonally stable region of the musical score for a confirmed tonal center, wherein the chord of each sonority in a tonally stable region is accounted as a functional symbol of that tonal center.

2. The tonal analysis method of claim 1, wherein:

each note of the musical score is represented by a note data record stored on a non-transitory computer-readable medium as an element of a voice data structure;

each voice data structure is stored on the non-transitory computer-readable medium as an element of a parts data structure;

each sonority is represented by a sonority data structure stored on the non-transitory computer-readable medium containing references to each of a subset of note data records of the plurality of note data records;

the sonority data structure is associated with a theory line entry data structure stored on the non-transitory computer-readable medium; and the accounting of each sonority as a functional symbol of a confirmed tonal center is stored in the theory line entry data structure.

3. The tonal analysis method of claim 2, wherein notes of a musical score are parsed by:

identifying a starting beat time for each note;

generating a timeline of all starting beat times;

at each starting beat time, sampling each note sounding at the starting beat time for the smallest note value and generating a sonority comprising the sampled notes;

determining a relative metric stress level for each sonority;

reducing the notes of each sonority to pitch class set notes.

4. The tonal analysis method of claim 3, further comprising:

converting pitch class set notes of a sonority to an interval set;

matching the interval set against a chord dictionary comprising intervals associated with chord identities;

if the interval set matches against an interval associated with a chord identity, classifying the interval set as the associated chord identity; and recording the associated chord identity in the theory line entry data structure associated with the sonority data structure representing the sonority.

5. The tonal analysis method of claim 2, further comprising:

identifying a non-sonority note of the notes of the musical score, where the non-sonority note is not included in any chord of a sonority;

testing the non-sonority note against a target sonority to determine whether the non-sonority note is a non-harmonic tone; and if the non-sonority note is a non-harmonic note, recording the identification of the non-sonority note as a non-harmonic note in the theory line entry data structure associated with the sonority data structure representing the sonority.

6. The tonal analysis method of claim 5, further comprising:

generating a melodic interval set for each non-harmonic tone;

matching the interval set against a non-harmonic tone model dictionary comprising melodic intervals associated with non-harmonic tone identities;

if the melodic interval set matches against a melodic interval associated with a non-harmonic tone identity, classifying the melodic interval set as the associated non-harmonic tone identity; and recording the associated non-harmonic tone identity in the theory line entry data structure associated with the sonority data structure representing the sonority.

7. The tonal analysis method of claim 1, wherein a pair of sonorities among the plurality of sonorities is tested for tonal center confirmation by evaluating a condition determining whether the test pair implies a tonal center tone, and a condition determining whether an implied tonal center tone is touched.

8. The tonal analysis method of claim 1, wherein a chord of a sonority is accounted against a confirmed tonal center by:

determining the interval between the root tone of the sonority and the tone of the confirmed tonal center;

matching the interval and the tone of the confirmed tonal center against a tonal center dictionary comprising scale degrees each associated with a tonal center tone and one or more chord models; and if the interval matches against a matching scale degree and the tone of the confirmed tonal center matches against the tonal center tone associated with the matching scale degree, then matching the chord of the sonority against the chord models associated with the matching scale degree;

if the chord of the sonority matches against a chord model associated with the matching scale degree, then accounting the chord of the sonority as a functional symbol of the confirmed tonal center; and recording the accounting of the chord of the sonority as a functional symbol of the confirmed tonal center in the theory line entry data structure associated with the sonority data structure representing the sonority.

9. The tonal analysis method of claim 1, wherein a chord of a sonority is accounted against a confirmed tonal center by:

claiming a region of the musical score between a pair of adjacent confirmations of a confirmed tonal center as a tonally stable region;

accounting each chord of a sonority within a tonally stable region as a functional symbol of the confirmed tonal center; and recording the accounting of the chord of the sonority as a functional symbol of the confirmed tonal center in the theory line entry data structure associated with the sonority data structure representing the sonority.

10. The tonal analysis method of claim 1, further comprising:

evaluating an error condition against a sonority; and if the error condition is true against the sonority, recording an error annotation in the theory line entry data structure associated with the sonority data structure representing the sonority.

11. The tonal analysis method of claim 1, further comprising generating an annotated representation of a musical score comprising musical score elements of the musical score, a theory line element, and markup token elements, wherein a theory line element has a display mode corresponding to a chord notation.

12. A non-transitory computer-readable medium, comprising:

computer code for implementing a tonal analysis method, the method comprising the steps of:

parsing notes of a musical score to generate a time-ordered plurality of sonorities, each sonority having a chord comprising a subset of notes of the musical score based on time value;

confirming a plurality of tonal centers each having a tone, each by testing a pair of sonorities among the plurality of sonorities;

accounting a chord of a sonority for a confirmed tonal center to determine whether the chord of the sonority is a functional symbol of the confirmed tonal center; and identifying a tonally stable region of the musical score for a confirmed tonal center, wherein the chord of each sonority in a tonally stable region is accounted as a functional symbol of that tonal center; and a note data record representing a note of the musical score stored as an element of a voice data structure;

a voice data structure stored as an element of a parts data structure;

a sonority data structure representing a sonority, containing references to each of a subset of note data records of the plurality of note data records, and associated with a theory line entry data structure wherein the accounting of each sonority as a functional symbol of a confirmed tonal center is stored.

13. The non-transitory computer-readable medium of claim 12, further comprising computer code for receiving and storing information input by a human user in the theory line entry data structure.

14. The non-transitory computer-readable medium of claim 12, further comprising:

computer code for receiving and storing assignment parameters input by a teacher user based on the theory line entry data structure on the non-transitory computer-readable medium;

a blank theory line entry data structure; and computer code for displaying a question prompt to a student user, and receiving and storing a student value by a student user in a blank theory line entry data structure in response to a question prompt.

15. The non-transitory computer-readable medium of claim 14, further comprising:

computer code for comparing the conformity of the student value to an authority value, and then deducting point values of error values from a total possible score;

wherein point values of error values and the total possible score are assignment parameters input by the teacher user.

* * * * *